US006482352B1

(12) United States Patent
Sakata et al.

(10) Patent No.: US 6,482,352 B1
(45) Date of Patent: Nov. 19, 2002

(54) METHOD OF MANUFACTURING WATCH-BRACELET COMPONENT

(75) Inventors: Masaaki Sakata, Matsumoto (JP); Junichi Hayashi, Okaya (JP)

(73) Assignee: Injex Corporation (JP)

( * ) Notice: Subject to any disclaimer, the term of this patent is extended or adjusted under 35 U.S.C. 154(b) by 0 days.

(21) Appl. No.: 09/868,976

(22) PCT Filed: Oct. 19, 2000

(86) PCT No.: PCT/JP00/07305

§ 371 (c)(1),
(2), (4) Date: Oct. 12, 2001

(87) PCT Pub. No.: WO01/28717

PCT Pub. Date: Apr. 26, 2001

(30) Foreign Application Priority Data

Oct. 20, 1999 (JP) ..... 11-298542

(51) Int. Cl.[7] ..... B22F 3/12; B22F 3/20

(52) U.S. Cl. ..... 419/26; 419/36; 419/41; 419/38

(58) Field of Search ..... 419/5, 26, 36, 419/41

(56) References Cited

U.S. PATENT DOCUMENTS 3,901,717 A * 8/1975 Revaz
4,649,003 A * 3/1987 Hashimoto et al. ..... 264/63
4,730,288 A * 3/1988 Loth
5,441,695 A * 8/1995 Gladden ..... 419/37
6,171,989 B1 * 1/2001 Yoshida ..... 501/93
6,200,916 B1 * 3/2001 Michel et al. ..... 501/32

FOREIGN PATENT DOCUMENTS

| | | |
|---|---|---|
| JP | 49-23709 | 3/1974 |
| JP | 2-221303 | 9/1990 |
| JP | 4-13804 | 1/1992 |
| TW | 70-36801 | 8/1977 |

OTHER PUBLICATIONS

Written Notification of Examination Report for Taiwan (Formosan) Application No. 891253 and English translation.
Bulletin of Powder Metallurgy Association, vol. 22, No. 3 (Aug. 1997).

* cited by examiner

*Primary Examiner*—Ngoclan Mai
(74) *Attorney, Agent, or Firm*—Harness, Dickey & Pierce, P.L.C.

(57) ABSTRACT

A method of the present invention manufactures a watch-bracelet component through step (1A) of producing a green body containing a raw material powder by extrusion molding, step (2A) of cutting the green body, step (3A) of debinding the cut green body, and step (4A) of sintering the debound body to yield a sintered body. Subsequently, the method can easily manufacture even a product having a complicated shape, and the invention can provide a method of manufacturing a watch-bracelet component with a wide range of materials to choose from.

24 Claims, 5 Drawing Sheets

METHOD OF MANUFACTURING WATCH-BRACELET COMPONENT

TECHNICAL FIELD

The present invention relates to a method of manufacturing a watch-bracelet component with the use of a sintered body.

BACKGROUND ART

Watch-bracelet components are roughly classified as a rolled bracelet and a block bracelet.

The rolled bracelet is manufactured by rolling a metal plate which has been cut to a predetermined length. The block bracelet is manufactured by pressing a metal block to a bracelet shape and then subjecting the pressed metal block to a required hole-processing.

In the manufacturing method of a rolled bracelet, the resulting bracelet cannot significantly have a complicated shape or have a pattern, since the bracelet has a simple structure formed only by rolling the metal plate. Additionally, the rolled bracelet inevitably has a joint of the metal plate, and has the risk of opening the joint. Accordingly, a subsequent step of bonding the joint by, for example, soldering is required in order to eliminate the joint of the metal plate.

Separately, the manufacturing method of a block bracelet cannot significantly form a complicated shape and there is a limit in shape of the resulting bracelet, since the bracelet is formed by pressing. Additionally, hole processing cannot be performed concurrently with pressing, and the manufacturing method requires an additional extra step.

Moreover, when the raw material of the watch-bracelet component is a hard-to-process material, the aforementioned two manufacturing methods cannot manufacture the product watch-bracelet component or require a great deal of effort and time.

As described above, the conventional manufacturing methods of a watch-bracelet component have disadvantages that there is a limit to the shape of the bracelet component, that the manufacturing processes are complicated, and that appropriate materials are confined.

An object of the present invention is to provide a method of manufacturing a watch-bracelet component, which can easily manufacture even the bracelet component has a complicated shape, and which has a wide range of materials to choose from.

SUMMARY OF THE INVENTION (1) A first method of manufacturing a watch-bracelet component according to the present invention includes the steps of:

subjecting a feed stock containing a raw material powder to extrusion molding to thereby form a long green body with an odd-shaped cross section having a hollow hole;

cutting the long green body to a predetermined length;

debinding the cut green body; and sintering the debound body to thereby yield a sintered body.

(2) A second method of manufacturing a watch-bracelet component according to the present invention includes the steps of:

subjecting a feed stock containing a raw material powder to extrusion molding to thereby form a long green body with an odd-shaped cross section having a hollow hole;

debinding the long green body;

cutting the debound body to a predetermined length; and sintering the cut debound body to thereby yield a sintered body.

(3) A third method of manufacturing a watch-bracelet component according to the present invention includes the steps of:

subjecting a feed stock containing a raw material powder to extrusion molding to thereby form a long green body with an odd-shaped cross section having a hollow hole;

debinding the long green body;

sintering the debound body to thereby yield a sintered body; and cutting the sintered body to a predetermined length.

(4) A fourth method of manufacturing a watch-bracelet component according to the present invention includes the steps of:

subjecting a feed stock containing a raw material powder to extrusion molding to thereby form a long green body with an odd-shaped cross section having a hollow hole;

debinding the long green body;

preliminary sintering the debound body to thereby yield a primary sintered body;

cutting the primary sintered body to a predetermined length; and finally sintering the cut primary sintered body to thereby yield a secondary sintered body.

(5) Preferably, two or more hollow holes are formed in the ultimately obtained sintered body.

(6) The hollow hole in the ultimately obtained sintered body preferably has a diameter of 0.3 to 5 mm.

(7) The raw material powder is preferably a metal powder or a ceramic powder.

(8) The ultimately obtained sintered body preferably has a porosity of less than 5%.

(9) The cutting length of the ultimately obtained sintered body can be preferably set at 2 mm or more in the cutting.

BEST MODE FOR CARRYING OUT THE INVENTION

A method of manufacturing a watch-bracelet component according to the present invention will be illustrated in detail below.

Figure 1:
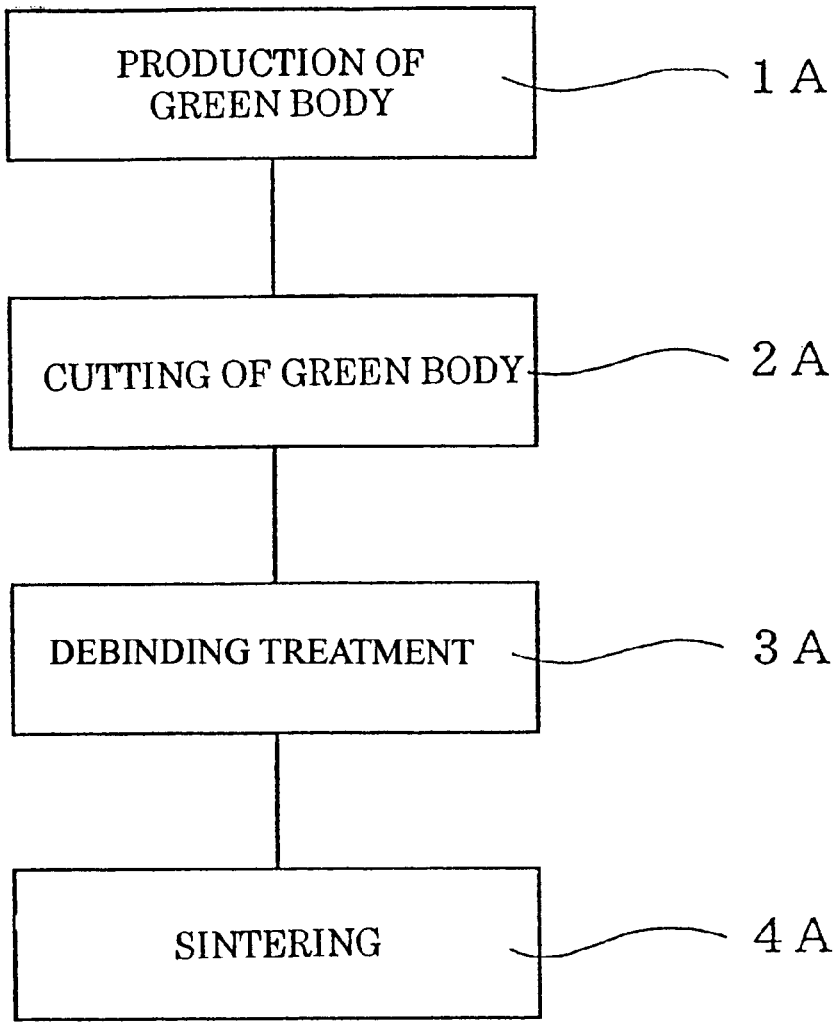
FIG. 1 is a process chart showing a first embodiment according to a method of manufacturing a watch-bracelet component of the present invention.
Figure 5:
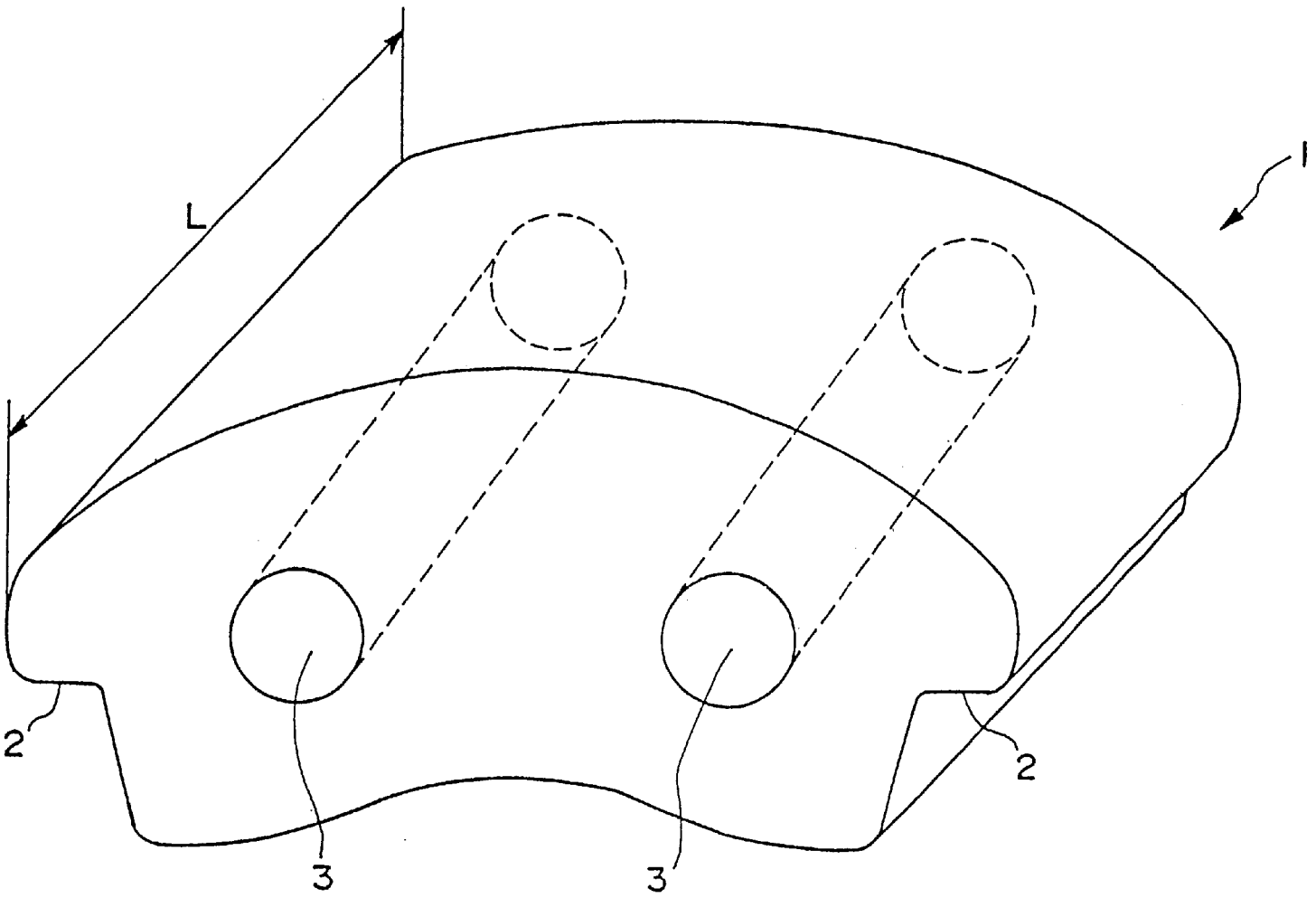
FIG. 5 is a perspective view showing an example of a watch-bracelet component manufactured by the method of manufacturing a watch-bracelet component of the present invention.

FIG. 1 is a process chart showing a first embodiment according to a method of manufacturing a watch-bracelet component of the present invention, and FIG. 5 is a perspective view showing an example of a watch bracelet component manufactured by the invention method of manufacturing a watch-bracelet component.

As shown in FIG. 5, watch-bracelet component 1 manufactured according to the present embodiment is uniform in cross sectional shape along with the direction of extrusion in extrusion molding operation mentioned below.

This cross sectional shape is a shape in which the upper side in the figure curves in the form of arc, riser parts 2 in the form of crank are on the both sides, the lower side in the figure is dented, and two circular hollow holes 3 are formed between the upper part and lower part in the figure. Two hollow holes 3 are formed so as to cut through watch-bracelet component 1 in parallel with the extrusion direction.

The profile and shape of the watch-bracelet component is not limited to the profile and shape shown in the figure. Additionally, the shape, number and the like of the hollow hole are not limited to those in the hollow holes shown in the figure.

The first embodiment of the method of manufacturing a watch-bracelet component will be described below.

[1A] Production of Green Body

According to the present invention, a green body is produced by extrusion molding with the use of a mixture (a feed stock) containing a raw material powder.

This extrusion molding is a processing method in which a feed stock is supplied into a cylinder and is pressed and is extruded from the opening of a die (a mold) to continuously extrude while controlling a cross sectional shape. This processing method has an advantage of continuously producing a long green body.

The processing method is more preferred particularly in the case of extrusion molding in which the cylinder and die are heated, since the method can reduce extrusion resistance of the feed stock and is excellent in formability.

The production of a green body by extrusion molding will be described below.

Initially, a raw material powder and a binder (an organic binder) are prepared and are kneaded in a kneader to yield a kneaded substance.

Such raw material powders include, for example, metal powders and ceramic powders.

Metallic materials constituting the metal powders (hereinafter simply referred to as "metallic materials") are not specifically limited and include at least one selected from among, for example, Fe, Ni, Co, Cr, Mn, Zn, Pt, Au, Ag, Cu, Pd, Al, W, Ti, V, Mo, Nb, and Zr, or an alloy (mainly) containing at least one of these metals.

In particular, the present invention can improve workability and therefore can easily manufacture the product even when the metallic material of the ultimately obtained sintered body has a relatively high hardness or is hard to process. Additionally, the metallic material is preferably resistant to corrosion due to, for example, sweat and has satisfactory corrosion resistance, since it comes in contact with the human body. Examples of such metallic materials include Ni-based alloys (e.g., NCF 600 and NCF 690), Fe-based alloys (e.g., stainless steel: SUS 304, SUS 310S, SUS 316, SUS 317, SUS 329J1, SUS 410, and SUS 430), Ti or Ti-based alloys, W or W-based alloys, Co-based allows (e.g., hard metals (cemented carbides)), and Ni-based cements.

The mean particle diameter of the metal powder is not specifically limited but is generally preferably 150 $\mu$m or less, and more preferably about 0.1 to 60 $\mu$m.

The manufacturing method of the metal powder is not specifically limited, and for example, metal powders manufactured by water- or gas-atomizing process, reduction process, carbonyl process, or pulverization process can be used. Among them, those obtained by atomizing process are preferred. A metal powder manufactured by gas atomizing process nearly has a spherical particle shape, and can yield high flowability of the feed stock even using a binder in a relatively small amount, can broaden extrusion conditions in extrusion molding operation mentioned below, and can prevent the formation of defects in the green body. This configuration can improve the mechanical properties of the resulting sintered body (bracelet component).

Next, ceramic materials constituting the ceramic powders (hereinafter simply referred to as "ceramic materials") are not specifically limited and include, for example, $ZrO_2$ (including partially stabilized zirconia), $Y_2O_3$, $Al_2O_3$, $TiO_2$ and other oxide ceramics, as well as WC, TiC, ZrC, SiC, $B_4C$, and other carbide ceramics, and TiN, AlN, $Si_3N_4$, ZrN, BN, and other nitride ceramics, and other non-oxide ceramics.

The mean particle diameter of the ceramic powder is not specifically limited but is generally preferably 50 $\mu$m or less, and more preferably about 0.05 to 40 $\mu$m. If the mean particle diameter is excessively large, sintering density may not be sufficiently improved depending on the other conditions.

The manufacturing method of the ceramic powder is not specifically limited, and ceramic powders manufactured by, for example, pulverization, spray pyrolysis, coprecipitation method, controlled crystallization of glass, or sol-gel process can be used.

The binder includes, for example, polyethylene, polypropylene, ethylene-vinyl acetate copolymer, and other polyolefins, poly-methyl methacrylate, poly-butyl methacrylate, and other acrylic resins, polystyrene and other styrenic resins, poly-vinyl chloride, polyvinylidene chloride, polyamide, polyester, polyether, poly-vinyl alcohol, or copolymers of these, and other various resins, various waxes, paraffin, higher fatty acids (e.g, stearic acid), higher alcohols, higher fatty acid esters, and higher fatty acid amides. Each of these substances can be used alone or in combination.

Additionally, the feed stock may further comprise a plasticizer. Such plasticizers include, for example, phthalic esters (e.g., DOP, DEP, and DBP), adipic esters, trimellitic esters, and sebacic esters. Each of these substances can be used alone or in combination.

In the kneading operation, various additives such as lubricants, antioxidants, debinding accelerators, and surfactants can be added according to necessity, in addition to the raw material powder, binder and plasticizer.

Kneading condition depends on various conditions including, for example, the composition or particle diameter of the used metal powder or ceramic powder, the compositions and amounts of the binder and additives. For example, a kneading temperature can be about 50° C. to 250° C., and a kneading time can be about 20 to 210 minutes.

Next, the above-obtained kneaded substance is extruded in an extruder to yield a green body in a desired shape and dimensions.

In this case, a green body having a hollow hole penetrating the green body throughout its length can be easily manufactured by appropriately selecting an extrusion die (mold) mounted on the extruder. Additionally, the kneaded substance heated in a cylinder is cooled and is solidified during the passage of the die, by setting, for example, appropriate cylinder temperature, extrusion die temperature (mold temperature), extrusion speed, and extrusion pressure. This procedure can continuously produce a long green body.

In this connection, the shape and dimensions of the green body to be manufactured are decided in expectation of shrinkage of the green body due to subsequent debinding and sintering operations.

The extrusion molding condition depends on various conditions including, for example, the composition or particle diameter of the used raw material powder, and the composition and amount of the binder. For example, a cylinder temperature is preferably about 100° C. to 350° C., a mold temperature is preferably about 30° C. To 150° C., an extrusion speed is preferably about 0.1 to 50 mm/sec, and an extrusion pressure is preferably 1000 kgf/cm$^2$ or less.

The content of the raw material powder in the green body is preferably about 80 to 98 wt % and more preferably about 85 to 95 wt %. If the content is less than 80 wt %, shrinkage in sintering of the green body increases to thereby deteriorate dimensional precision. In contrast, if it exceeds 98 wt %, the content of the binder is relatively decreased and flowability in molding is deteriorated. As a result, it is impossible or hard to perform extrusion molding or the composition of the green body becomes uneven.

[2A] Cutting of Green Body

The long green body with an odd-shaped cross section obtained in the step [1A] is cut to a predetermined length.

The cutting operation is performed using a conventional metal saw, cutter of another cutting apparatus.

The conventional method of manufacturing a block bracelet by pressing requires different press molding dies corresponding to the lengths in the manufacture of bracelets having different lengths. However, according to the present invention, the cutting length can be changed and a variety of watch-bracelet components having different lengths can be easily manufactured by changing the cutting length, and a plurality of dies as in the conventional method are not required.

Additionally, the cutting length (L) of watch-bracelet component 1 is preferably 2 mm or more, and more preferably about 3 to 10 mm, as shown in FIG. 5. If the cutting length is excessively short, the cutting cycle becomes short, and dimensional precision cannot be significantly maintained and stability is deteriorated.

Furthermore, the green body has a lower hardness than a sintered body and can be easily cut regardless of the composition of the raw material powder and is excellent in workability. By this configuration, the green body can be cut more easily than cutting of a hard sintered body, without the use of a cutting blade composed of, for example, a hard metal or a diamond cutter or the like. Accordingly, the facilities of the cutting apparatus can be simplified. In addition, the target to be cut has a low hardness and the load (e.g., wear, damage) of the cutting blade or the like can be reduced and the life in use can be prolonged.

In this connection, when watch-bracelet component 1 as shown in FIG. 5 is formed, the cutting length is decided in expectation of shrinkage of the green body due to subsequent debinding and sintering operations.

[3A] Debinding Treatment of Green Body

The green body cut in the step [2A] is subjected to debinding treatment.

In this case, the debinding treatment is preferably performed at a temperature of about 150° C. to 750° C. for 20 to 2200 minutes, and more preferably at a temperature of about 250° C. to 650° C. for 50 to 1300 minutes. In the debinding in this case, treatment can be finished for a shorter time than the debinding in the cases where debinding is performed before cutting, as described in the following embodiments 2 to 4. This is because the surface area of the green body is increased due to cutting to thereby accelerate the progress of debinding. This can shorten the working time can be shortened.

Alternatively, the debinding by heat treatment may be performed in plural steps (stages) according to various objects (e.g., the object of shortening the debinding time). This case includes, for example, a process in which the first half of the steps is performed at a low temperature and the last half is performed at a high temperature, and a process in which a low-temperature treatment and a high-temperature treatment are repeated in turn.

Additionally, the pressure of the atmosphere in debinding may be varied in plural steps (stages) in combination with the above heat treatment. This case includes, for example, a process in which the first half of the steps is performed under a reduced pressure (e.g., $1\times10^{-3}$ Torr) and the last half is performed at atmospheric pressure (ambient pressure), and a process in which a reduced-pressure treatment and an atmospheric pressure treatment are repeated in turn.

The combination of the heat treatment and the pressure of the atmosphere can subject the green body to the debinding treatment more efficiently.

In this connection, the debinding treatment may be performed by another process such as a process in which the binder or a specific ingredient in the additive is dissolved out using a predetermined solvent (a liquid or a gas).

[4A] Sintering of Green Body

The debound body thus obtained is sintered by heating in a sintering furnace to thereby yield a metal sintered body and ceramic sintered body.

The raw material powder is diffused and grain in particle to become a crystal particle. In this case, voids disappear to thereby yield a dense, i.e., high density low porosity sintered body on the whole.

A sintering temperature in sintering is preferably about 950° C. to 1500° C. , and more preferably about 1000° C. to 1450° C. when the metal composition is Ni or a Ni-based alloy; it is preferably about 1000° C. to 1500° C. and more preferably about 1050° C. to 1450° C. when the metal composition is Fe or an Fe-based alloy; and it is preferably about 950° C. to 1500° C. and more preferably about 1000° C. to 1450° C. when the metal composition is Ti or a Ti-based alloy.

The sintering temperature is preferably about 1300° C. to 2000° C. and more preferably about 1400° C. to 1850° C. when the ceramic composition is an oxide ceramic; it is preferably about 1400° C. to 2150° C. and more preferably about 1500° C. to 2150° C. when the ceramic composition is a carbide ceramic; and it is preferably about 1300° C. to 1900° C. and more preferably about 1400° C. to 1850° C. when the ceramic composition is a nitride ceramic.

In this connection, the sintering temperature may vary (increase or decrease) with time within or out of the above range.

A sintering time is preferably about 30 to 480 minutes and more preferably about 60 to 300 minutes when the aforementioned sintering temperature is employed.

When the raw material powder is a metal powder, a sintering atmosphere is not specifically limited but is preferably a reduced pressure (vacuum) or a non-oxidative atmosphere. This configuration can prevent deterioration in properties due to oxidation of the metal and contributes to reduction of the porosity of the sintered body. When the raw material powder is an oxide ceramic, the sintering atmosphere is preferably an air (atmospheric) atmosphere or an inert gas atmosphere. When the raw material powder is a carbide ceramic or a nitride ceramic, the sintering atmosphere is preferably an inert gas atmosphere. This configuration contributes to reduction of the porosity of the sintered body.

When the raw material powder is a metal powder, the sintering atmosphere is preferably a reduced pressure (vacuum) atmosphere of 1 Torr or less (more preferably $1\times10^{-2}$ to $1\times10^{-6}$ Torr) or an inert gas atmosphere such as nitrogen gas or argon gas at a pressure of 1 to 760 Torr, or a hydrogen gas atmosphere at a pressure of 1 to 760 Torr. When the raw material powder is an oxide ceramic, the sintering atmosphere is preferably an inert gas atmosphere such as nitrogen gas or argon gas at a pressure of 1 to 760 Torr or an air (atmospheric) atmosphere at a pressure of 1 to 760 Torr. When the raw material powder is a carbide ceramic or a nitride ceramic, the sintering atmosphere is preferably an inert gas atmosphere such as nitrogen gas or argon gas at a pressure of 1 to 760 Torr.

In this connection, the sintering atmosphere may vary during the sintering operation. For example, the sintering is initially performed at a reduced pressure (vacuum) of $1\times10^{-2}$ to $1\times10^{-6}$ Torr and the atmosphere may be changed to the aforementioned inert gas during the operation.

The sintering operation under the aforementioned condition can reduce the porosity of the sintered body. The porosity of the sintered body is preferably less than 7%, and more preferably less than 5%. Reduction in porosity contributes to a higher density of the sintered body, yields a high strength and high dimensional precision, prevents sintering defects, and yield a satisfactory appearance. Additionally, reduction in porosity also yields a high sintering efficiency, and can perform sintering for a shorter time to thereby improve productivity. In particular, extrusion molding can form or mold a feed stock even if the feed stock has a high viscosity and can reduce the amount of the binder in the feed stock as compared with injection molding. It is generally known that large amounts of a binder in a feed stock prevents the resulting product from having a high density in sintering to thereby invite a high porosity. The present invention employs extrusion molding and can yield a sintered body having a lower porosity than a conventional product formed by injection molding. The present invention is therefore greatly advantageous in improvement of appearance (aesthetic appearance) and corrosion resistance required as a bracelet component.

The sintering may be performed in two or more stages. For example, a primary sintering and a secondary sintering each having different sintering conditions can be performed. In this case, the sintering temperature in the secondary sintering can be higher than that in the primary sintering. This configuration can further improve sintering efficiency and can further reduce the porosity.

The diameter of hollow hole 3 formed in such watch bracelet component 1 is decided in expectation of shrinkage of the green body due to sintering. The diameter of hollow hole 3 after sintering is not specifically limited but is preferably 0.3 to 5 mm and more preferably 0.5 to 3 mm. If the diameter of the hollow hole is excessively large, the thickness of the watch-bracelet becomes relatively thin to thereby invite sufficient strengths when the watch-bracelet component is relatively small. In contrast, if the diameter of the hollow hole is excessively small, a pin to connect each watch-bracelet component cannot be penetrated.

The method according to the present invention may further include a pre-step prior to the step [1A], an intermediate step between the steps [1A] and [4A] or after-step subsequent to the step [4A] with any aim.

In this connection, surface polishing operations such as burring, cleaning, and polishing can be added as an after-step. By this procedure, the surface of the watch-bracelet component becomes tidy and the appearance becomes more satisfactory.

Additionally, all of the surface of the watch-bracelet component can be subjected to a surface treatment. Such surface treatments include, for example, gold plating, chromium plating, palladium plating, and other metal plating operations, and other wet plating operations; ion plating, sputtering, vacuum deposition, and other dry plating operations; and nitriding treatment and other surface hardening treatments. This procedure can further improve corrosion resistance of the surface of the watch-bracelet component. Furthermore, the formation of a hardened layer on the surface of the watch-bracelet component can yield a watch-bracelet component which is resistant to scratch.

Additionally, the sintered body has a low porosity and can be subjected to surface finishing such as buffing, barreling, chemical polishing and other mirror polishing processing. This procedure can further improve the appearance.

Next, a second embodiment of the invented method of manufacturing a watch-bracelet component will be described below.

Figure 2:
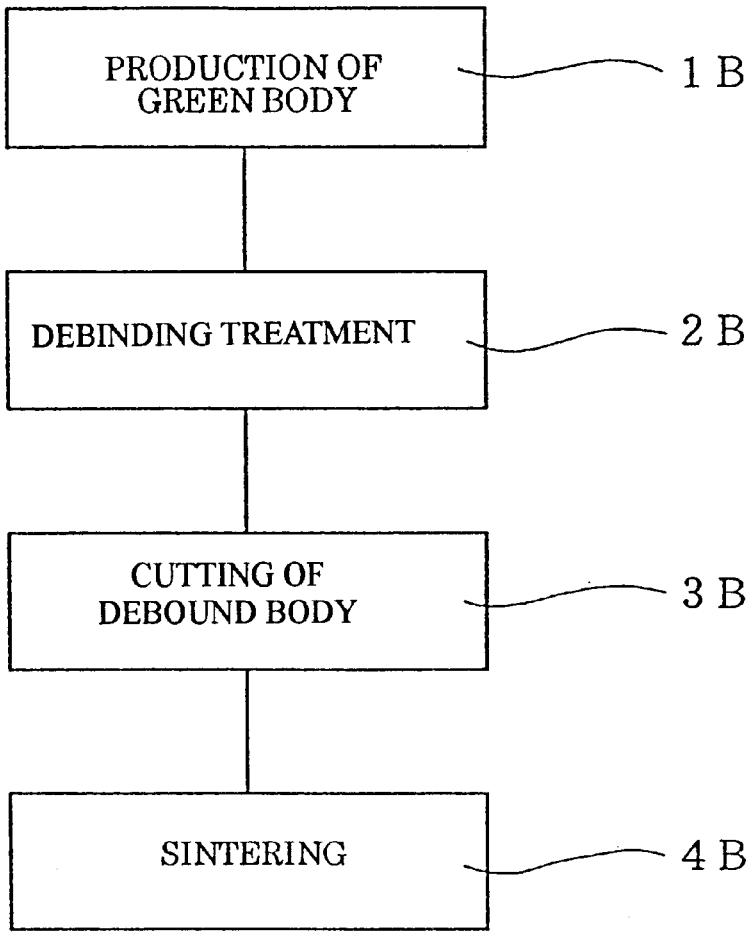
FIG. 2 is a process chart showing a second embodiment according to the method of manufacturing a watch-bracelet component of the present invention.

FIG. 2 is a process chart showing the second embodiment of the invented method of manufacturing a watch-bracelet component. In this second embodiment, a long debound body is cut to a predetermined length, and the other procedures are same as in the first embodiment.

[1B] Production of Green Bay

The procedure is the same as in the step [1A].

[2A] Debinding Treatment of Green Body

A debinding time depends on the composition or particle diameter of the used raw material powder, the compositions and the amounts of the binder and additives, and other conditions. For example, the debinding treatment is performed in the same manner as in the step [3A], except that the debinding treatment is preferably performed at a temperature of about 150° C. to 750° C. for 30 to 2400 minutes and more preferably at a temperature of about 250° C. to 650° C. for 60 to 1440 minutes.

[3B] Cutting of Debound Body

The long debound body with an odd-shaped cross section obtained in the step [2B] is cut to a predetermined length.

The cutting length is similar to those mentioned in the step [2A].

The debound body has a lower hardness than a sintered body, and can be easily cut regardless of the composition of the raw material powder, that is, the debound body is excellent in workability. Accordingly, a variety of watch-bracelet components having different lengths can be efficiently manufactured. Additionally, the dimension of the cutting length can be easily controlled to thereby manufacture the product with a good dimensional precision. This method is also advantageous in processing of an article having a complicated and fine shape as compared processing of a sintered body.

[4B] Sintering of Green Body

The procedure is the same as in the step [4A].

The method according to the present invention may further include a pre-step prior to the step [1B], an intermediate step between the steps [1B] and [3B], or an after-step subsequent to the step [4B] with any aim.

Next, a third embodiment of the invented method of manufacturing a watch-bracelet component will be described below.

Figure 3:
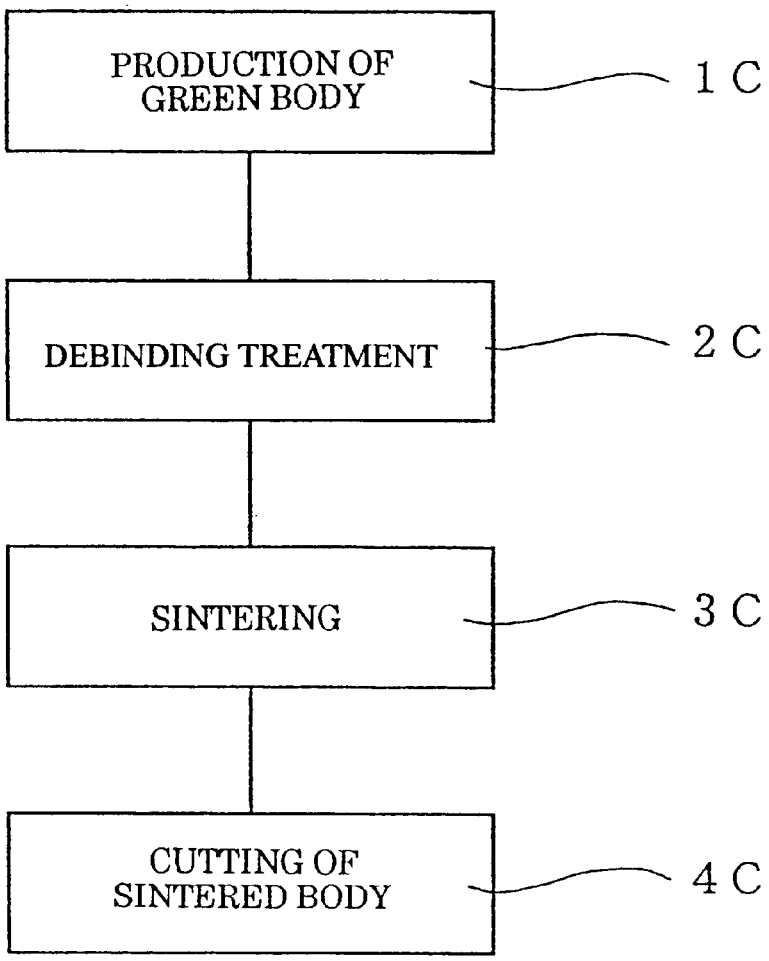
FIG. 3 is a process chart showing a third embodiment according to the method of manufacturing a watch-bracelet component of the present invention.

FIG. 3 is a process chart showing the third embodiment of the invented method of manufacturing a watch-bracelet component. In this third embodiment, a long sintered body is cut to a predetermined length, and the other procedures are same as in the first embodiment

[1C] Production of Green Body

The procedure is the same as the step [1A].

[2C] Debinding Treatment of Green Body

A debinding time depends on the composition or particle diameter of the used raw material powder, the compositions and the amounts of the binder and additives, and other conditions. For example, the debinding treatment is performed in the same manner as in the step [3A], except that the debinding treatment is preferably performed at a temperature of about 150° C. to 750° C. for 30 to 2400 minutes and more preferably at a temperature of about 250° C. to 65° C. for 60 to 1440 minutes.

[3C] Sintering of Green Body

The procedure is the same as in the step [4A].

[4C] Cutting of Sintered Body

The long sintered body with an odd-shaped cross section obtained in the step [3C] is cut to a predetermined length.

The cutting length is similar to those described in the step [2A].

The sintered body after sintering is compacted, and cutting of the sintered body results in less variation of cutting length dimension and yields a high dimensional precision. Accordingly, this method is advantageous when the product watch-bracelet component requires a high dimensional precision.

The method according to the present invention may further include a pre-step prior to the step [1C], an intermediate step between the steps [1C] and [3C], or an after-step subsequent to the step [4C] with any aim.

Next, a fourth embodiment of the invented method of manufacturing a watch-bracelet component will be described below.

Figure 4:
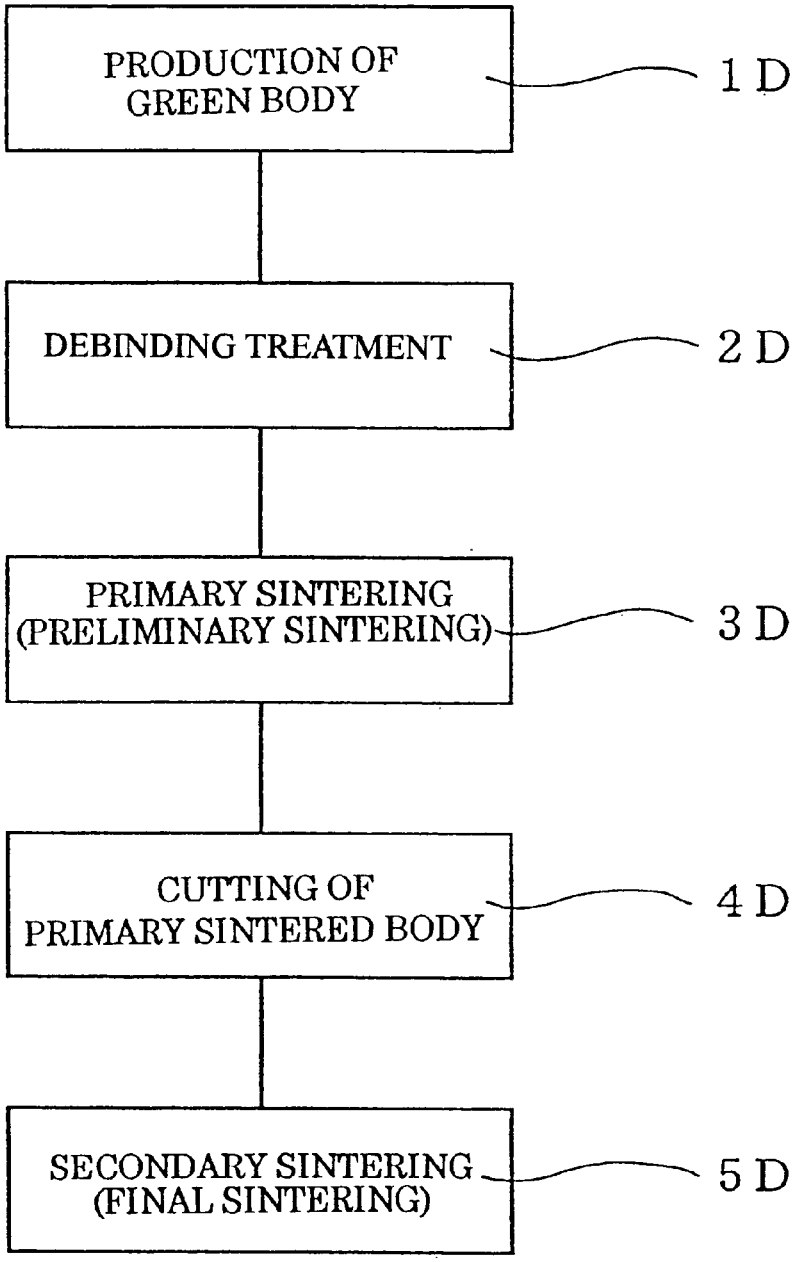
FIG. 4 is a process chart showing a fourth embodiment according to the method of manufacturing a watch-bracelet component of the present invention.

FIG. 4 is a process chart showing the fourth embodiment of the invented method of manufacturing a watch-bracelet component. In the fourth embodiment, a debound body is subjected to primary sintering (preliminary sintering) and the long primary sintered body is then cut to a predetermined length. The other procedures are the same as in the first embodiment. This embodiment will be illustrated with reference to each of the drawings.

[1D] Production of Green Body

The procedure is the same as in the step [1A].

[2D] Debinding Treatment of Green Body

A debinding time depends on the composition of particle diameter of the used raw material powder, the compositions and the amounts of the binder and additives, and other conditions. For example, the debinding treatment is performed in the same manner as in the step [3A], except that the debinding treatment is preferably performed in a temperature of about 150° C. to 750° C. for 30 to 2400 minutes and more preferably at a temperature of about 250° C. to 650° C. for 60 to 1440 minutes.

[3D] Primary Sintering (Preliminary Sintering) of Green Body

The debound body thus obtained is subjected to primary sintering by heating in a sintering furnace to thereby yield a metal sintered body and a ceramic sintered body.

The primary sintering is preferably performed until the contact points of the raw material powder particles are at least diffused and are bonded. Such a primary sintering can increase dimensional stability and more surely prevent the disintegration of the green body (primary sintered body) and the occurrence of loss, cracking and other defects in subsequent steps, and improve handling property.

A sintering temperature in the primary sintering is, for example, preferably about 750° C. to 1300° C. and more preferably about 850° C. to 1250° C. when the metal composition is Ni or a Ni-based alloy; it is preferably about 700° C. to 1300° C. and more preferably about 800° C. to 1250° C. when the metal composition is Fe or an Fe alloy; and it is preferably about 700° C. to 1200° C. and more preferably about 800° C. to 1150° C. when the metal composition is Ti or a Ti-based alloy.

Alternatively, the sintering temperature is preferably about 800° C. to 1500° C. and more preferably about 950° C. to 1350° C. when the ceramic composition is an oxide ceramic; it is preferably about 850° C. to 1500° C. and more preferably about 950° C. to 1400° C. when the ceramic composition is a carbide ceramic; and it is preferably about 800° C. to 1500° C. and more preferably about 950° C. to 1300° C. when the ceramic composition is a nitride ceramic.

In this connection, the sintered temperature in the primary sintering may vary (increase and decrease) with time within or out of the aforementioned range.

A primary sintering time is preferably about 12 to 360 minutes, and more preferably about 30 to 240 minutes when the aforementioned sintering temperature is employed.

When the raw material powder is a metal powder, a sintering atmosphere is not specifically limited but is preferably a reduced pressure (vacuum) or a non-oxidative atmosphere. This configuration can prevent deterioration in properties due to oxidation of the metal and contributes reduction of the porosity of the sintered body. When the raw material powder is an oxide ceramic, the sintering atmosphere is preferably an air (atmospheric) atmosphere or an inert gas atmosphere. When the raw material powder is a carbide ceramic or a nitride ceramic, the sintering atmosphere is preferably an inert gas atmosphere. This configuration contributes to reduction of the porosity of the sintered body.

When the raw material powder is a metal powder, the sintering atmosphere is preferably a reduced pressure (vacuum) atmosphere of 1 Torr or less (more preferably $1\times10^{-2}$ to $1\times10^{-6}$ Torr), or an inert gas atmosphere such as nitrogen gas or argon gas at a pressure of 1 to 760 Torr, or a hydrogen gas atmosphere at a pressure of 1 to 760 Torr. When the raw material powder is an oxide ceramic, the sintering atmosphere is preferably an inert gas atmosphere such as nitrogen gas or argon gas at a pressure of 1 to 760 Torr or an air (atmospheric) atmosphere at a pressure of 1 to 760 Torr. When the raw material powder is a carbide ceramic or a nitride ceramic, the sintering atmosphere is preferably an inert gas atmosphere such as nitrogen gas or argon gas at a pressure of 1 to 760 Torr.

In this connection, the sintering atmosphere may vary during the sintering operation. For example, the sintering is initially performed at a reduced pressure (vacuum) of $1\times10^{-2}$ to $1\times10^{-6}$ Torr and the atmosphere is changed to the aforementioned inert gas during the operation.

The sintering operation under these conditions contributes to reduction of the porosity, i.e., to increase the density of the sintered body.

[4D] Cutting of Primary Sintered Body

The green body after the primary sintering is cut to a predetermined length.

The cutting length is similar to those mentioned in the step [2A].

The green body of primary sintered body has a lower hardness than a completely sintered body, and can be easily cut regardless of the composition of the raw material powder. Dimensional error in cutting length is low and the dimensional precision is increased, since the primary sintered body has a lower shrinkage due to sintering than that in a debound green body or an extruded green body.

In this connection, the dimension of the cutting length in cutting of the primary sintered body is determined in expectation of shrinkage of the primary sintered body due to the subsequent secondary sintering.

[5D] Secondary Sintering (Final Sintering) of Green Body

Due to the secondary sintering, the raw material powder particles are diffused with each other and grow in particle to thereby form a crystal. In this case, voids disappear to thereby yield a dense, i.e., a high density low porosity sintered body on the whole.

A sintering temperature in the secondary sintering is, for example, preferably about 950° C. to 1500° C. and more preferably about 1000° C. to 1450° C. when the metal composition is Ni or a Ni-based alloy; it is preferably about 1000° C. to 1500° C. and more preferably about 1050° C. to 1450° C. when the metal composition is Fe or an Fe-based alloy; and it is preferably about 950° C. to 1500° C. and more preferably about 1000° C. to 1450° C. when the metal composition is Ti or a Ti-based alloy. In this case, the sintering temperature is preferably higher than that in the preliminary sintering.

Alternatively, the sintering temperature is preferably about 1300° C. to 2000° C., and more preferably about 1400° C. to 1850° C. when the ceramic composition is an oxide ceramic; it is preferably about 1400° C. to 2150° C., and more preferably about 1500° C. to 2150° C. when the ceramic composition is a carbide ceramic; and it is preferably about 1300° C. to 1900° C., and more preferably about 1400° C. to 1850° C. when the ceramic composition is a nitride ceramic. The sintering temperature is also preferably higher than that in the preliminary sintering in this case.

In this connection, the sintering temperature in the secondary sintering may vary (increase or decrease) with time within or out of the aforementioned range.

A secondary sintering time is preferably about 30 to 480 minutes, and more preferably about 60 to 300 minutes when the aforementioned sintering temperature is employed.

When the raw material powder is a metal powder, a sintering atmosphere is not specifically limited but is preferably a reduced pressure (vacuum) atmosphere or a non-oxidative atmosphere. This configuration can prevent deterioration in properties due to oxidation of the metal and contributes reduction of the porosity of the sintered body. When the raw material powder is an oxide ceramic, the sintering atmosphere is preferably an air (atmospheric) atmosphere or an inert gas atmosphere. When the raw material powder is a carbide ceramic or a nitride ceramic, the sintering atmosphere is preferably an inert gas atmosphere. This configuration contributes to reduction of the porosity of the sintered body.

When the raw material powder is a metal powder, the sintering atmosphere is preferably a reduced pressure (vacuum) atmosphere of 1 Torr or less (more preferably $1\times10^{-2}$ to $1\times10^{-6}$ Torr), an inert gas atmosphere such as nitrogen gas or argon gas at a pressure of 1 to 760 Torr, or a hydrogen gas atmosphere at a pressure of 1 to 760 Torr. When the raw material powder is an oxide ceramic, the sintering atmosphere is preferably an inert gas atmosphere such as nitrogen gas or argon gas at a pressure of 1 to 760 Torr or an air (atmospheric) atmosphere at a pressure of 1 to 760 Torr. When the raw material powder is a carbide ceramic or a nitride ceramic, the sintering atmosphere is preferably an inert gas atmosphere such as nitrogen gas or argon gas at a pressure of 1 to 760 Torr.

In this connection, the sintering atmosphere may vary during the sintering operation. For example, the sintering is initially performed at a reduced pressure (vacuum) of $1\times10^{-2}$ to $1\times10^{-6}$ Torr and the atmosphere may be changed to the aforementioned inert gas during the operation.

Additionally, the sintering atmosphere in the secondary sintering (final sintering) may be identical to or different from that in the primary sintering.

The sintering operation under the aforementioned conditions contributes to reduction of porosity, i.e., to increase in density of the sintered body, and can yield a high dimensional precision. Additionally, since the sintering is performed in plural stages (installments), the sintering efficiency is improved and the sintering can be finished for a shorter sintering time to thereby improve productivity.

In this connection, the method of the present invention may further include a pre-step prior to the step [1D], an intermediate step between the steps [1D] and [5D], or an after-step subsequent to the step [5D] with any aim.

EXAMPLES

Next, the specific examples of the invented method of manufacturing a watch-bracelet component will be described below.

Example 1

To 95 wt % of this metal powder, a binder composed of 1.5 wt % of polystyrene (PS), 1.5 wt % of ethylene-vinyl acetate copolymer (EVA), and 1.3 wt % of paraffin wax, and 0.7 wt % of dibutyl phthalate (plasticizer) were added and mixed, and these were kneaded in a kneader at 100° C. for 1 hour.

Next, the resulting kneaded substance was extrusion-molded to yield a long green body having two parallel hollow holes (hole diameter: 1.5 mm (target dimension after sintering: 1.3 mm in hole diameter)) with an odd-shaped cross section (the shape shown in FIG. 5). The molding condition is extrusion molding was such that the cylinder temperature was 140° C., mold temperature was 70° C., extrusion pressure was 120 kgf/cm$^2$, and extrusion speed was 10 mm/sec.

This long green body was cut to predetermined lengths to yield green bodies (50 pieces) cut to a length of 2.5 mm (target dimension after sintering: 2.2 mm in cutting length) with an odd-shaped cross section, and green bodies (50 pieces) cut to a length of 3.9 mm (target dimension after sintering: 3.5 mm in cutting length)) with an odd-shaped cross section.

This green body was subjected to debinding treatment using a debinding furnace. In debinding operation, the green body was held at 500° C. in a nitrogen atmosphere at 760 Torr (ambient pressure) for 50 minutes.

Next, the debound green body was sintered using a sintering furnace to yield a sintered body. The sintering was performed at 1330° C. in an Ar gas atmosphere at 760 Torr (ambient pressure) for 180 minutes.

Example 2

A watch-bracelet component was manufactured in the same manner as in Example 1, except that a long debound body was cut to predetermined lengths in the same manner as above. In this connection, the debinding time was set at 500° C. for 60 minutes.

Example 3

A watch-bracelet component was manufactured in the same manner as in Example 1, except that a long sintered body was cut to predetermined lengths in the same manner as above. In this connection, the debinding time was set at 500° C. for 60 minutes, and the sintering time was set at 1330° C. for 180 minutes.

Example 4

A watch-bracelet component was manufactured in the same manner as in Example 1, except the following procedures. The sintering step was divided into primary sintering (preliminary sintering) and secondary sintering (final sintering). The primary sintering was performed at 1100° C. under at a reduced pressure of $1\times10^{-4}$ Torr for 180 minutes, and the secondary sintering was performed at 1310° C. in an Ar gas atmosphere at 760 Torr (ambient pressure) for 120 minutes. A long primary sintered body (preliminary sintered body) was cut to predetermined lengths in the same manner as above. In this connection, the debinding time was set at 500° C. for 60 minutes.

Example 5

A yttria-partially-stabilized zirconia (composition: $ZrO_2$-5.5 wt % $Y_2O_3$) powder having a mean particle diameter of 1 $\mu$m produced by spray pyrolysis was prepared as a ceramic powder.

To 85 wt % of this ceramic powder, a binder composed of 4.5 wt % of polystyrene (PS), 4.5 wt % of ethylene-vinyl acetate copolymer (EVA) and 3.9 wt % of paraffin wax, and 2.1 wt % of dibutyl phthalate (plasticizer) were added and mixed, and these are kneaded at 110° C. for 90 minutes in a kneader.

Next, the resulting kneaded substance was extrusion-molded to yield a long green body having two parallel hollow holes (hole diameter: 1.7 mm (target dimension after sintering: 1.3 mm in hole diameter)) with an odd-shaped cross section (the shape shown in FIG. 5). The molding condition in extrusion molding was such that the cylinder temperature was 140° C., mold temperature was 70° C., extrusion pressure was 90 kgf/cm$^2$, and extrusion speed was 3 mm/sec.

This long green body was cut to predetermined lengths to yield green bodies (50 pieces) cut to a length of 2.9 mm (target dimension after sintering: 2.2 mm in cutting length) with an odd-shaped cross section, and green bodies (50 pieces) cut to a length of 4.6 mm (target dimension after sintering: 3.5 mm in cutting length)) with an odd-shaped cross section.

This green body was subjected to debinding treatment using a debinding furnace. In debinding operation, the green body was held at 450° C. in a nitrogen atmosphere at 760 Torr (ambient pressure) for 50 minutes.

Next, the debound green body was sintered in a sintering furnace to yield a sintering body. The sintering was performed at 1450° C. in an Ar gas atmosphere at 760 Torr (ambient pressure) for 180 minutes.

Example 6

A watch-bracelet component was manufactured in the same manner as in Example 5, except that a long debound body was cut to predetermined lengths in the same manner as above. In this connection, the debinding time was set at 450° C. for 60 minutes.

Example 7

A watch-bracelet component was manufactured in the same manner as in Example 5, except that a long sintered body was cut to predetermined lengths in the same manner as above. In this connection, the debinding time was set at 450° C. for 60 minutes, and the sintering time was set at 1450° C. for 180 minutes.

Example 8

A watch-bracelet component was manufactured in the same manner as in Example 5, except the following procedures. The sintering step was divided into primary sintering (preliminary sintering) and secondary sintering (final sintering). The primary sintering was performed at 1000° C. in an Ar gas atmosphere at 10 Torr for 180 minutes, and the secondary sintering was performed at 1425° C. in an Ar gas atmosphere at 760 Torr (ambient pressure) for 120 minutes. A long primary sintered body (preliminarily sintered body) was cut to predetermined lengths in the same manner as above. In this connection, the debinding time was set at 450° C. for 60 minutes.

Evaluation of Properties and Quality

Each of the sintered bodies of Examples 1 to 8 was cut in various directions, and the cut end faces thereof were visually observed to verify the presence or absence of sintering defects. The results are shown in Table 1.

Separately, the dimensional error (an error with respect to the target dimension: the average of each 50 pieces) of each cutting length of the sintered bodies ultimately obtained in Examples 1 to 8 was determined, and the results are shown in Table 1. In this table, the dimensional error A shows the results in the case where the target dimension was 2.2 mm, and the dimensional error B shows the results in the case where the target dimension was 3.5 mm.

Additionally, each process time (a total time of the debinding time and the sintering time) for performing debinding treatment and sintering in Examples 1 to 8 is shown in Table 1.

As shown in Table 1, each of the watch-bracelet components of Examples 1 to 8 exhibited no sintering defect and was verified to be a sintered body with satisfactory quality. Additionally, each of the dimensional errors of each cutting length in Example 1 to 8 was small, indicating a high dimensional precision. Furthermore, the aforementioned results of the presence or absence of sintering defects and dimensional precision verify that each of the watch-bracelet components of Examples 1 to 8 can yield a watch-bracelet component with satisfactory quality regardless of each process time.

As described above, the present invention can easily manufacture even a product having a complicated shape and can yield a high density watch-bracelet component with a high dimensional precision.

Additionally, the invention can easily manufacture a variety of watch-bracelet components by controlling cutting lengths and is excellent in productivity and can supply watch-bracelet components at low cost.

Industrial Applicability

The invention method of manufacturing a watch-bracelet component can manufacture a watch-bracelet component even by the use of, for example, a hard material which has been conventionally hard to process. Accordingly, the method can enlarge the functions and shapes (designs) of watch-bracelet components.

TABLE 1

| Example | Sintering Defect | Dimensional Error A [%] | Dimensional Error B [%] | Process Time [min] |
|---|---|---|---|---|
| Example 1 (green body/cutting) | none | ±1.3 | ±1.0 | 230 |
| Example 2 (debound body/cutting) | none | ±1.3 | ±1.0 | 240 |
| Example 3 (sintered body/cutting) | none | ±0.5 | ±0.3 | 240 |
| Example 4 (preliminary sintered body/cutting) | none | ±0.6 | ±0.4 | 360 |
| Example 5 (green body/cutting) | none | ±1.5 | ±1.1 | 230 |
| Example 6 (debound body/cutting) | none | ±1.5 | ±1.1 | 240 |
| Example 7 (sintered body/cutting) | none | ±0.5 | ±0.3 | 240 |
| Example 8 (preliminary sintered body/cutting) | none | ±0.6 | ±0.4 | 360 |

What is claimed is:

1. A method of manufacturing a watch-bracelet component, comprising the steps of:

subjecting a feed stock containing a raw material powder to extrusion molding to thereby form a long green body with a non-uniform cross section having at least one hollow hole;

cutting said long green body to a predetermined length;

debinding said cut green body; and sintering said debound body to thereby yield a sintered body.

2. A method of manufacturing a watch-bracelet component, comprising the steps of:

subjecting a feed stock containing a raw material powder to extrusion molding to thereby form a long green body with a non-uniform cross section having at least one hollow hole;

debinding said long green body;

cutting said debound body to a predetermined length; and sintering said cut debound body to thereby yield a sintered body.

3. A method of manufacturing a watch-bracelet component, comprising the steps of:

subjecting a feed stock containing a raw material powder to extrusion molding to thereby form a long green body with a non-uniform cross section having at least one hollow;

debinding said long green body;

sintering said debound body to thereby yield a sintered body; and cutting said sintered body to a predetermined length.

4. A method of manufacturing a watch-bracelet component, comprising the steps of:

subjecting a feed stock containing a raw material powder to extrusion molding to thereby form a long green body with a non-uniform cross section having at least one hollow hole;

debinding said long green body;

preliminary sintering said debound body to thereby yield a primary sintered body;

cutting said primary sintered body to a predetermined length; and finally sintering said cut primary sintered body to thereby yield a secondary sintered body.

5. A method of manufacturing a watch-bracelet component according to claim 1, wherein said sintered body includes two or more holes formed therein.

6. A method of manufacturing a watch-bracelet component according to claim 1, wherein the hollow hole in said ultimately obtained sintered body has a diameter of 0.3 to 5 mm.

7. A method of manufacturing a watch-bracelet component according to claim 1, wherein said raw material powder is a metal powder or a ceramic powder.

8. A method of manufacturing a watch-bracelet component according to claim 1, wherein said ultimately obtained sintered body has a porosity of less than 5%.

9. A method of manufacturing a watch-bracelet component according to claim 1, wherein the cutting length of said ultimately obtained sintered body can be set at 2 mm or more in said cutting.

10. A method of manufacturing a watch-bracelet component according to claim 2, wherein said sintered body includes two or more holes formed therein.

11. A method of manufacturing a watch-bracelet component according to claim 2, wherein the hollow hole in said ultimately obtained sintered body has a diameter of 0.3 to 5 mm.

12. A method of manufacturing a watch-bracelet component according to claim 2, wherein said raw material powder is a metal powder or a ceramic powder.

13. A method of manufacturing a watch-bracelet component according to claim 2, wherein said ultimately obtained sintered body has a porosity of less than 5%.

14. A method of manufacturing a watch-bracelet component according to claim 2, wherein the cutting length of said ultimately obtained sintered body can be set at 2 mm or more in said cutting.

15. A method of manufacturing a watch-bracelet component according to claim 3, wherein said sintered body includes two or more holes formed therein.

16. A method of manufacturing a watch-bracelet component according to claim 3, wherein the hollow hole in said ultimately obtained sintered body has a diameter of 0.3 to 5 mm.

17. A method of manufacturing a watch-bracelet component according to claim 3, wherein said raw material powder is a metal powder or a ceramic powder.

18. A method of manufacturing a watch-bracelet component according to claim 3, wherein said ultimately obtained sintered body has a porosity of less than 5%.

19. A method of manufacturing a watch-bracelet component according to claim 3, wherein the cutting length of said ultimately obtained sintered body can be set at 2 mm or more in said cutting.

20. A method of manufacturing a watch-bracelet component according to claim 4, wherein said sintered body includes two or more holes formed therein.

21. A method of manufacturing a watch-bracelet component according to claim 4, wherein the hollow hole in said ultimately obtained sintered body has a diameter of 0.3 to 5 mm.

22. A method of manufacturing a watch-bracelet component according to claim 4, wherein said raw material powder is a metal powder or a ceramic powder.

23. A method of manufacturing a watch-bracelet component according to claim 4, wherein said ultimately obtained sintered body has a porosity of less than 5%.

24. A method of manufacturing a watch-bracelet component according to claim 4, wherein the cutting length of said ultimately obtained sintered body can be set at 2 mm or more in said cutting.

* * * * *

UNITED STATES PATENT AND TRADEMARK OFFICE

CERTIFICATE OF CORRECTION

PATENT NO. : 6,482,352 B1
DATED : November 19, 2002
INVENTOR(S) : Sakata et al.

It is certified that error appears in the above-identified patent and that said Letters Patent is hereby corrected as shown below:

Column 1,
Line 46, “has” should be -- having --;

Column 3,
Line 67, “cements” should be -- cermets --;

Column 5,
Line 17, “To” should be -- to --;
Line 22, “95 wt%” should be -- 98 wt% --;
Line 33, “of” should be -- or --;

Column 6,
Line 11, delete “can be shortened”;

Column 8,
Line 3, “sufficient” should be -- insufficient --;
Line 40, after “are” insert -- the --;
Line 42, “Bay” should be -- Body --;
Line 45, “[2A]” should be -- [2B] --;

Column 9,
Line 5, after “compared” insert -- to --;
Line 21, after “are” insert -- the --;
Line 22, insert a period after “embodiment”;
Line 36, “65ºC” should be -- 650ºC --;

Column 13,
Line 9, “is” should be -- in --;
Line 52, delete “at”;

Column14,
Line 27, “sintering” should be -- sintered --;
Line 60, delete “Evaluation of Properties and Quality”;

Column 15,
Line 15, “Example” should be -- Examples --;

UNITED STATES PATENT AND TRADEMARK OFFICE

CERTIFICATE OF CORRECTION

PATENT NO. : 6,482,352 B1
DATED : November 19, 2002
INVENTOR(S) : Sakata et al.

It is certified that error appears in the above-identified patent and that said Letters Patent is hereby corrected as shown below:

Column 16,
Line 14, after "hollow" insert -- hole --;
Line 26, "preliminary" should be -- preliminarily --.

Signed and Sealed this

Fourth Day of November, 2003

JAMES E. ROGAN
*Director of the United States Patent and Trademark Office*